United States Patent [19]

Watkins

[11] Patent Number: 4,503,787

[45] Date of Patent: Mar. 12, 1985

[54] LOW PILE NEEDLE PLATE FOR A TUFTING MACHINE

[75] Inventor: Charles W. Watkins, Ooltewah, Tenn.

[73] Assignee: Tuftco Corporation, Chattanooga, Tenn.

[21] Appl. No.: 538,944

[22] Filed: Oct. 4, 1983

[51] Int. Cl.[3] ..... D05C 15/00
[52] U.S. Cl. ..... 112/79 R
[58] Field of Search ..... 112/79 R

[56] References Cited

U.S. PATENT DOCUMENTS 4,384,538 5/1983 Slattery ..... 112/79 R
4,397,249 8/1983 Slattery ..... 112/79 R

*Primary Examiner*—Ronald Feldbaum
*Attorney, Agent, or Firm*—Harrington A. Lackey

[57] ABSTRACT

A needle plate made of thin, solid sheet material, preferably with a notched rear or trailing edge for receiving corresponding needles in a transverse row, to permit the looper hooks to reciprocate closely adjacent the bottom of the base fabric in order to produce tufted loops of very low pile height.

9 Claims, 4 Drawing Figures

LOW PILE NEEDLE PLATE FOR A TUFTING MACHINE

BACKGROUND OF THE INVENTION

This invention relates to multiple needle tufting machines, and more particularly to a needle plate for producing low pile in a multiple needle tufting machine.

In a conventional multiple needle tufting machine, the needle plate is provided with a plurality of uniformly spaced straight fingers extending from one edge of the plate in the direction of the fabric feed, or rearward, so that each finger extends between an adjacent pair of needles. These fingers are adapted to provide a support for the portion of the base fabric in the path of the needles and are spaced to permit free reciprocation of the needles between the fingers. In a conventional multiple needle tufting machine, the needle plate fingers are uniformly spaced at the same gauge as the needles.

Furthermore, a conventional needle plate finger has a rectangular cross-section, with its short dimension transverse, and its long dimension vertical. Thus, each cantilevered needle plate finger has substantial depth to provide sufficient strength to support the base fabric as the fabric is penetrated by the needles. Moreover, the short transverse dimension of each needle plate finger is desirable so that the needles can be spaced closer together to achieve finer gauges.

However, the combined depth of the needle plate finger and the height of the looper hook bill moving across a corresponding needle below the needle plate, determines the minimum pile height of the tufted loops formed by the needles and hooks.

Generally speaking, in order to form tufted loops of low pile having as short a nap as possible, the hooks are mounted to move as closely as possible beneath the bottom surface of the needle plate fingers, and the height of the bills of the loopers is reduced to a minimum. To reduce the depth of conventional needle plate fingers, would materially reduce their strength and rigidity to a degree that the needle plate fingers would not adequately support the base fabric as it is penetrated by the needles carrying the yarns.

Examples of various types of prior art needle plates are shown in the following U.S. patents:

| | | |
|---|---|---|
| 2,975,736 | J. L. Card | Mar. 21, 1961 |
| 2,976,829 | R. T. Card | Mar. 28, 1961 |
| 3,019,748 | J. L. Card | Feb. 6, 1962 |
| 3,064,600 | R. T. Card | Nov. 20, 1962 |
| 3,241,507 | G. D. Dedmon et al | Mar. 22, 1966 (Base plate 62-FIG. 4) |
| 3,361,095 | J. T. Short | Jan. 2, 1968 |
| 3,398,708 | R. T. Card | Aug. 27, 1968 |

Both J. L. Card patents disclose typical conventional needle plates having longitudinal grooves receiving elongated needle plate fingers of rectangular cross-section having a greater depthwise dimension.

The three R. T. Card patents disclose needle plates having needle plate fingers of varying configurations to accommodate narrow gauge, staggered needles.

The Dedmond et al patent discloses a "usual base plate 62" in which the needle plate fingers appear to have been formed by milling the trailing edge of the base plate to produce long needle plate fingers of substantial depth.

The Short patent discloses a needle plate of substantial thickness having a plurality of uniquely shaped recesses in the trailing edge of the needle plate especially formed to accommodate hollow, cylindrical needles of the type through which a fluid is discharged to carry the yarn through the hollow needle and fabric.

None of the above patents disclose a needle plate which is capable of producing very low pile loops in a tufted fabric.

There has been a trend in the tufting industry toward the production of tufted fabrics having a very low, as well as dense, pile, simulating products resembling velvet. The height of the tufted loops have been reduced by reducing the height of the bills of the looper hooks, but further reduction of the pile height has been limited by the finite depth of the needle plate fingers.

SUMMARY OF THE INVENTION

It is therefore an object of this invention to provide a uniquely constructed needle plate, as well as the combination of the needle plate and the looper hook for producing the tufted loops of lower pile heights than tufted products heretofore commercially produced.

The low pile needle plate made in accordance with this invention has a vertical thickness substantially less than the height of the conventional needle plate fingers. The needle plate made in accordance with this invention eliminates the needle plate fingers. The needle plate is solid, formed of a thin, monolithic sheet of material, preferably tempered spring steel, which has a rear or trailing edge, preferably notched, which is located closely adjacent the paths of at least one row of needles reciprocating in a multiple needle tufting machine.

By combining the thin solid needle plate made in accordance with this invention and looper hooks having bills of reduced heights, in a multiple needle tufting machine, pile heights have been produced as low as 1/10 of an inch to 5/32 of an inch. The lowest, previously obtainable, tufted pile height has been in the range of $\frac{1}{4}$ of an inch.

In a preferred form of the needle plate, a plurality of uniformly spaced notches are formed in the free or trailing edge of the transversely mounted, solid plate so that each notch accommodates a corresponding needle in one row as the needles penetrate the base fabric supported on the needle plate. The projecting portions of the trailing edge of the needle plate are spaced closely adjacent each needle in a second or rear transverse row of a staggered needle arrangement, so that the base fabric is supported closely adjacent each needle in both rows of the staggered needle pattern.

DESCRIPTION OF THE PREFERRED EMBODIMENT

Figures 1, 2:
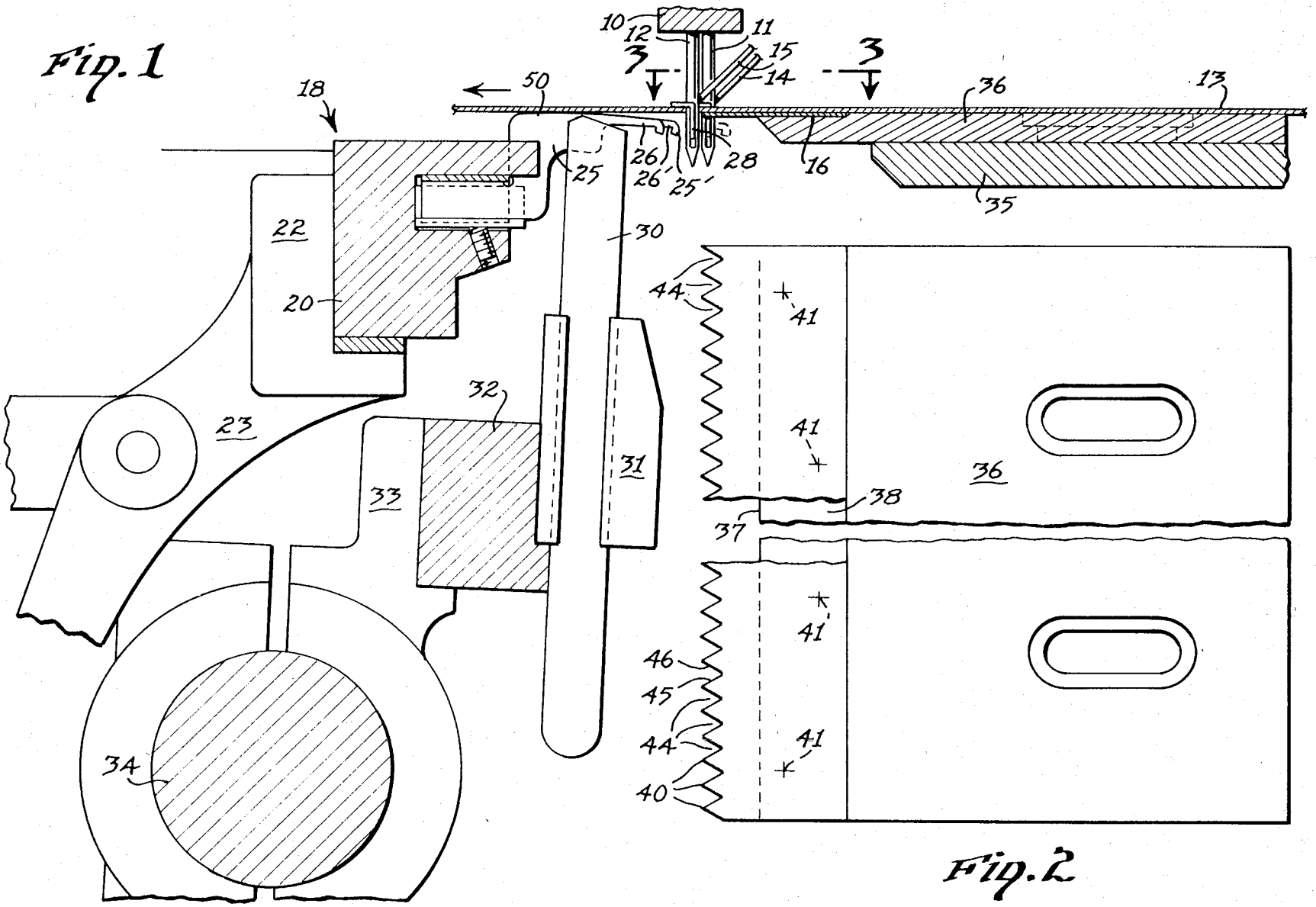
FIG. 1 is a fragmentary sectional elevation of a multiple needle tufting machine, incorporating the needle plate made in accordance with this invention, and showing the needles and looper hooks in retracted solid-line positions, and the looper hooks in a phantom forward, inoperative position.
FIG. 2 is a plan view of a needle plate section and its mounting plate, with portions broken away.

Referring now to the drawings in more detail, FIG. 1 discloses a transverse needle bar 10 in a conventional multiple-needle tufting machine supporting a first row of uniformly spaced needles 11 and a second row of uniformly spaced rear needles 12 offset mid-way between the front needles 11, to provide a uniform, narrow gauge, staggered needle tufting machine. The needle bar 10 is vertically reciprocated by conventional means, not shown, to cause the front and rear needles 11 and 12 to move between an upper position (FIG. 1) above the base fabric 13 to a lower position (FIG. 4) penetrating the base fabric 13, so that the needles will carry yarns 14 and 15 through the base fabric 13 to form loops of tufting therein.

Figure 4:
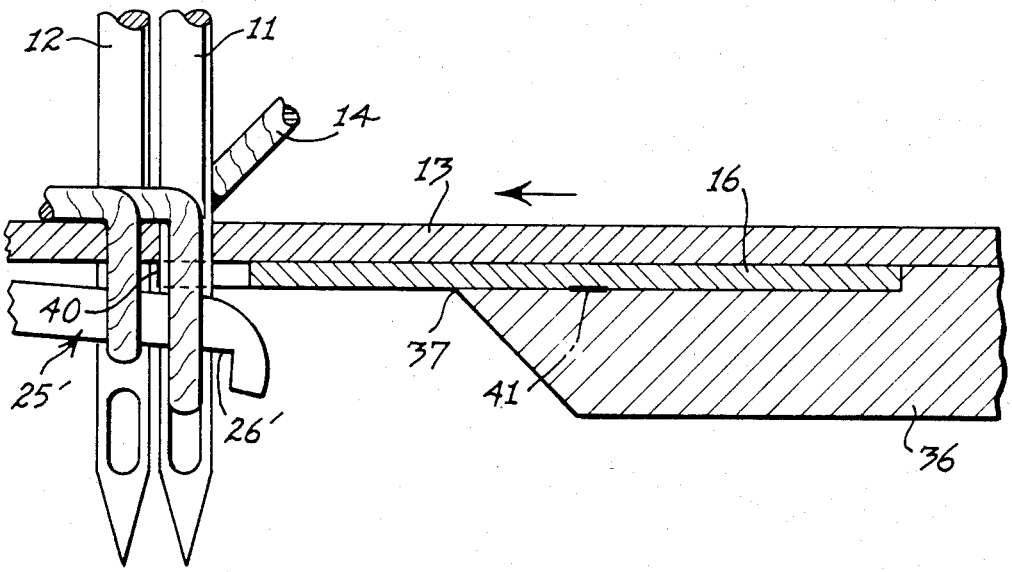
FIG. 4 is a fragmentary section taken along the line 4—4 of FIG. 3, showing the base fabric fragmentarily, and the operative position of a front looper hook, shown fragmentarily in phantom.

The base fabric 13 is supported upon the needle plate 16, made in accordance with this invention, for movement, by means not shown, in the direction of the arrow in FIG. 4, that is longitudinally from front-to-rear through the machine.

The looper apparatus 18 which cooperates with the needles 11 and 12 includes a transverse hook bar 20 supported upon a plurality of transversely spaced brackets 22 fixed to corresponding rocker arms journaled on a rock shaft, not shown. The rock shaft is driven by conventional means, not shown, connected to the rocker arms 23 for limited reciprocable movement in synchronism with the reciprocable movement of the needles 11 and 12.

Supported within the hook bar 20 are a plurality of transversely spaced looper hooks 25 and 25'. The structure of the alternating hooks 25 and 25' are identical, except that the bills 26' of the looper hooks 25' are slightly longer than the bills 26 of the looper hooks 25, to permit the bills 26 and 26' to cross their corresponding needles 12 and 11 by substantially the same amount in order to seize the corresponding yarns 15 and 14 to form the tufted loops 28.

As disclosed in the drawings, the looper hooks 25 and 25' are cut pile hooks with barbed ends, pointing forward in the direction opposing fabric feed.

A knife 30 is provided for each looper hook 25 and 25' to cooperate with the corresponding hooks 25 and 25' to produce cut pile tufts. The knives 30 are mounted in knife blocks 31 carried upon a transverse knife bar 32, which in turn is carried by the arms 33 mounted on the reciprocably driven rotary knife shaft 34. The knife shaft 34 and the means for driving the hook bar 20 and the needle bar 10 are all driven synchronously by means well-known in the art to cause the needles 11 and 12, the looper hooks 25 and 25' and the knives 30 to cooperate to form cut pile tufts from the yarns 14 and 15.

The needle plate assembly comprises a plurality of needle plates or needle plate sections, arranged end-to-end transversely of the tufting machine. Each needle plate 16 is preferably made of a rectangular sheet of unitary solid material, such as spring steel, of very thin guage or thickness. The needle plate 16 is mounted upon an elongated mounting plate 36 having a rear edge 37, and adapted to be supported upon the bed plate 35 of the machine.

Preferably, the rear top portion of the mounting plate 36 includes recess 38 to receive the front portion of the needle plate 16, so that the rear or trailing edge 40 of the needle plate 16 extends transversely of the machine between the rows of needles 11 and 12, and is spaced rearwardly of the rear edge 37 of the plate to provide clearance for the forward movement of the looper hooks 25 and 25'.

The needle plate 16 may be secured in the recess 38 of the mounting plate 36 by any conventional securing means, such as the spot welds 41 (FIG. 4). Thus, the top surface of the needle plate 16 may be supported flush with the top surface of the mounting plate 36 to provide a co-planar surface over which the base fabric 13 may be moved.

In the staggered needle arrangement as disclosed in the drawings, a plurality of open notches 44, preferably of uniform size and transverse spacing, are formed in the trailing edge 40 of the needle plate 16. Each notch 44 is only large enough to accommodate, that is to receive, a front needle 11 as it penetrates the base fabric 13. The edges 45 and 46 of each notch 44 are spaced as closely as possible to a corresponding needle 11 to support the maximum area of the base fabric 13 adjacent the corresponding needle 11, without interfering with the movement of the respective needles 11.

Figure 3:
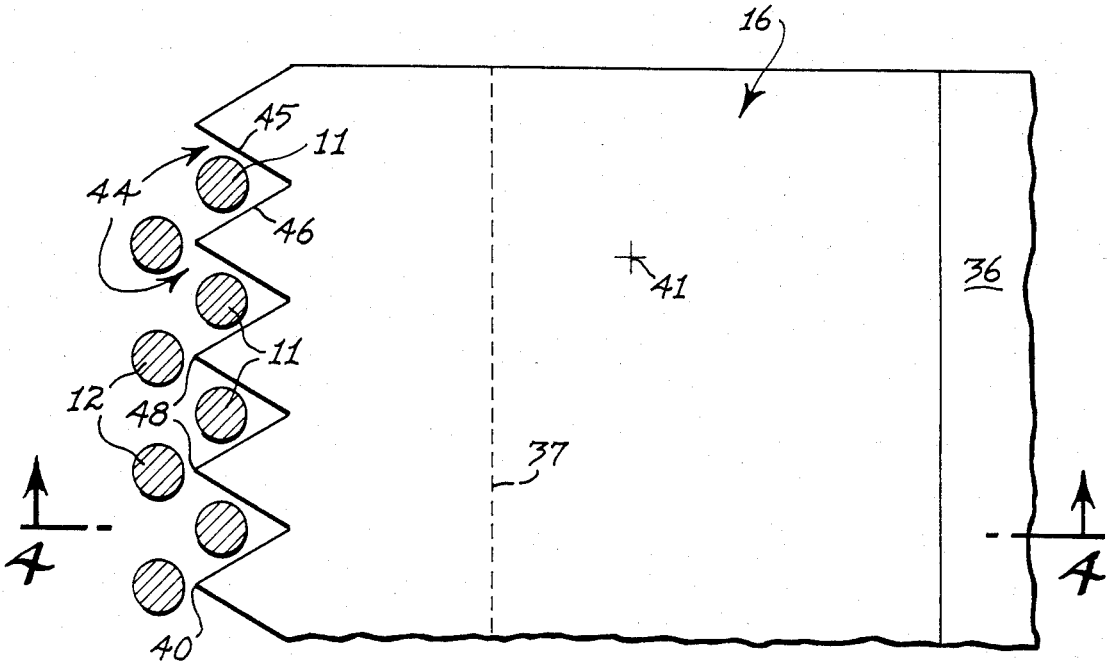
FIG. 3 is an enlarged, fragmentary plan section taken along the line 3—3 of FIG. 1.

As disclosed in FIG. 3, the notches 44 are V-shaped, each having a pair of opposed angular edges 45 and 46 disposed closely adjacent the opposite sides of the path of a corresponding needle 11. The walls 45 and 46 diverge symetrically about the longitudinal median of the angular notch 44, which median coincides with the center of each corresponding needle 11.

The diverging side walls 45 and 46 open through the trailing edge 40 of the needle plate 16 to provide ample room for the exit of each tufted loop formed by the corresponding needles 11.

The trailing edge 40 of the needle plate 16 interrupted by the notches 44 define pointed portions 48 which are preferably longitudinally centered with each corresponding rear needle 12, and located as close as possible to the vertical reciprocable path of each needle 12 in the rear row of needles. Thus, each pointed portion 48 provides support for the corresponding areas of the base fabric 13 adjacent and rearward of each corresponding needle 12, as the needles 12 penetrate the base fabric 13.

Because of the thinness of the needle plate 16, the bills 26 and 26' of the needles 25 and 25' respectively may be positioned at higher elevations than is customary, to reciprocate forward closely adjacent the bottom surface of the needle plate 16 and consequently quite close to the base fabric 13, to permit the formation of very low pile tufts or tufted loops.

As best disclosed in FIG. 1, the loopers 25 and 25' are supported in such an elevated position, because of the thinness of the needle plate 16, that the top surfaces 50 of the looper hooks 25 and 25' adequately support portions of the base fabric 13 adjacent and to the rear or trailing side of the needles 11 and 12.

In a typical construction of the needle plate 16, the thickness of the solid material of the needle plate 16 is about 0.030–0.040 inches. Conventional looper hooks having bills 26 and 26' of depths of 0.075–0.125 inches may be successfully used with the thin needle plate 16, so that the total distance between the bottom surface of the base fabric 13 and the bottom edge of the hook bills 26 and 26' may only be approximately 0.105 inches to 0.165 inches. Thus, low pile tufts of 5/32 of an inch in depth have been easily manufactured, and naps of lesser height may be formed by using thinner looper bills 26 and 26'.

It is also within the scope of this invention to use the needle plate 16 in conjunction with an in-line tufting machine in which there is only a single transverse row of uniformly spaced needles, such as the row 11. In an in-line tufting machine, the notches 44 may be smaller, providing just sufficient room for clearance of each corresponding needle 11 as it penetrates the base fabric 13. Where the notches 44 are smaller, they may intersect the trailing edge 40 at spaced positions to provide connecting straight edges instead of the pointed portions 48.

By utilizing a needle plate 16 of substantially continuously solid material, and locating the trailing edge 40 and the notches 44 as close as possible to the paths of the reciprocating needles, substantial support is provided for the base fabric 13, with a substantially reduced thickness of the solid material from which the needle plate 16 is made. The thinness of the needle plate 16 then permits higher elevations for the looper hooks as they cross the respective needles penetrating the base fabric to produce low pile tufted fabrics with very short naps or pile heights.

Furthermore, spacing the side walls 45 and 46 of the notches 44 as close as possible to the respective needles 11, not only provides maximum support for the base fabric in the vicinity of the needles 11, but also assists in guiding the needles 11 after they have penetrated the base fabric and are moving within the respective notches 44.

Each V-shaped notch 44 utilized in the needle plate 16 made in accordance with this invention, defines an angle of 60° between the diverging side walls 45 and 46. However, other angles may be utilized in the formation of the notches 44. Moreover, the notches 44 do not have to be V-shaped, but could have an arcuate formation.

What is claimed is:

1. In a multiple needle tufting machine having a transverse row of reciprocable needles for carrying yarn through a base fabric movable longitudinally through the machine, and a looper hook for each needle having a bill for seizing and forming a loop in each yarn carried through the base fabric by the corresponding needle, fabric support means for supporting the base fabric between the needles and the looper hooks, comprising:

(a) an elongated needle plate having a longitudinal dimension and a transverse dimension, and being integrally formed of solid material substantially throughout its longitudinal and transverse dimensions, (b) said needle plate having a free transverse edge portion, and having a thickness substantially less than the portions of the looper hook seizing the yarn carried by a corresponding needle, (c) a support member having a rear portion extending transversely of the machine, (d) means fixing said needle plate to said support member so that said free edge portion extends transversely of the machine, closely adjacent the reciprocable paths of the transverse row of needles, and spaced rearward of said rear portion sufficient to permit free, unobstructed reciprocable movement of the looper hooks at an elevated position beneath and closely adjacent said needle plate.

2. The invention according to claim 1 further comprising a looper hook for each needle including a bill having a predetermined depth, means for reciprocably moving said looper hooks to an operative position in which each bill crosses a corresponding needle penetrating the base fabric to seize and form a loop in the yarn carried by the corresponding needle, said operative position being elevated beneath and closely adjacent said free transverse edge portion of said needle plate to produce low pile loops in the base fabric.

3. The invention according to claim 2 in which said looper hook comprises a cut pile looper hook pointing longitudinally forward, and further comprising a knife for each looper hook and means for reciprocably moving said knives to cooperate with said corresponding looper hooks to form low cut pile tufts.

4. The invention according to claim 3 in which each looper hook has a pointed end, said means for reciprocably moving said looper hooks being adapted to move the pointed ends of said looper hooks beneath said needle plate to said operative position in which the pointed ends are spaced slightly forward of said free transverse edge portion, the remaining portions of said looper hooks extending rearwardly from said free transverse edge portion at an elevation for supporting the base fabric moving rearwardly from said needle plate.

5. The invention according to claim 1 in which the thickness of said needle plate is approximately 0.030–0.040 inches.

6. The invention according to claim 1 further comprising a plurality of notches formed in said free edge portion, there being one notch for receiving each needle as the needles penetrate the base fabric, said notches opening rearward.

7. The invention according to claim 6 in which each of said notches comprises a pair of opposed walls on opposite sides of the path of the corresponding reciprocable needle, and said side walls diverge rearwardly to form the opening through said transverse edge portion, to permit the free passage of the tufted pile loops rearwardly.

8. The invention according to claim 7 further comprising staggered reciprocable needles arranged in a front transverse row of uniformly spaced needles and a rear transverse row of uniformly spaced needles, uniformly offset from the needles in said front row, said notches receiving said corresponding front needles when penetrating the base fabric, the divergent side walls of said notches terminating in trailing edge portions connecting the openings of said notches, each of said trailing edge portions being spaced closely adjacent and in substantial longitudinal alignment with a corresponding needle path in said rear row.

9. The invention according to claim 7 in which each of said notches is V-shaped.

* * * * *